US008906122B2

(12) United States Patent
Van Dyk et al.

(10) Patent No.: US 8,906,122 B2
(45) Date of Patent: Dec. 9, 2014

(54) COAL PROCESSING OPERATION COMPRISING A DENSE MEDIA SEPARATION STAGE TO SEPARATE A COAL FEEDSTOCK INTO LOWER AND HIGHER ASH COAL STREAMS

(75) Inventors: Johannes Christoffel Van Dyk, Vanderbiklpark (ZA); Frans Boudewijn Waanders, Potchefstroom (ZA)

(73) Assignee: Sasol Technology (Proprietary) Limited, Johannesburg (ZA)

( * ) Notice: Subject to any disclaimer, the term of this patent is extended or adjusted under 35 U.S.C. 154(b) by 962 days.

(21) Appl. No.: 13/055,688

(22) PCT Filed: May 14, 2009

(86) PCT No.: PCT/IB2009/052007

§ 371 (c)(1),
(2), (4) Date: Jan. 24, 2011

(87) PCT Pub. No.: WO2010/010472

PCT Pub. Date: Jan. 28, 2010

(65) Prior Publication Data

US 2011/0120013 A1 May 26, 2011

(30) Foreign Application Priority Data

Jul. 25, 2008 (ZA) ..... 2008/06498

(51) Int. Cl.

| | |
|---|---|
| ***C01B 3/36*** | (2006.01) |
| ***C10L 9/08*** | (2006.01) |
| ***C10J 3/20*** | (2006.01) |
| ***C10J 3/54*** | (2006.01) |
| ***C10J 3/72*** | (2006.01) |

(52) U.S. Cl.

CPC .... *C10L 9/08* (2013.01); *C10J 3/20* (2013.01); *C10J 3/54* (2013.01); *C10J 3/721* (2013.01); *C10J 2300/093* (2013.01)

USPC ..... 48/197 R

(58) Field of Classification Search

CPC ..... C10J 2300/093; C10J 2300/0956; C10J 2300/0973; C10J 3/54; C10J 2200/09; C10J 2300/0903; C10J 2300/0906; C10J 2300/0959; C10J 2300/0976; C10J 2300/0983; C10J 2300/0986; C10J 2300/1853; B03B 9/005; B03B 4/02; B03B 1/00; B03B 5/00; B03B 5/34; B03B 9/02

See application file for complete search history.

(56) References Cited

U.S. PATENT DOCUMENTS 3,971,639 A * 7/1976 Matthews ..... 48/202
3,998,607 A * 12/1976 Wesselhoft et al. ..... 48/197 R (Continued)

FOREIGN PATENT DOCUMENTS

| | | |
|---|---|---|
| DE | 30 06 911 | 9/1981 |
| GB | 1 571 176 | 7/1980 |
| WO | WO 91/06618 | 5/1991 |

OTHER PUBLICATIONS

International Search Report and Written Opinion of the International Searching Authority, issued for PCT/IB2009/052007, dated Mar. 19, 2010; 9 pages.

(Continued)

*Primary Examiner* — Imran Akram
(74) *Attorney, Agent, or Firm* — Fulbright & Jaworski LLP

(57) ABSTRACT

A coal processing operation (10) includes in a dense media separation stage (12), subjecting a coal feedstock (18) which includes minerals to dense media separation producing a first coal stream (20) and a second coal stream (22). Coal in the first coal stream (20) is lower in ash and has a lower ash fusion temperature than coal in the second coal stream (22). Coal from the first coal stream (20) is processed in a high temperature coal processing operation (44), and coal from the second coal stream (22) is processed in a medium temperature coal processing operation (16).

8 Claims, 4 Drawing Sheets

(56) References Cited

U.S. PATENT DOCUMENTS

| | | | | | |
|---|---|---|---|---|---|
| 4,030,893 | A | * | 6/1977 | Keller | 208/424 |
| 4,133,747 | A | * | 1/1979 | Visman | 209/10 |
| 4,169,786 | A | | 10/1979 | Horsfall | |
| 4,313,737 | A | * | 2/1982 | Massey et al. | 241/1 |
| 4,325,819 | A | * | 4/1982 | Altizer | 209/10 |
| 4,338,188 | A | * | 7/1982 | Guerre | 209/2 |
| 4,343,627 | A | * | 8/1982 | Tanca | 48/202 |
| 4,392,940 | A | * | 7/1983 | Tao | 208/414 |
| 4,394,215 | A | * | 7/1983 | Jager et al. | 196/14.52 |
| 4,408,723 | A | * | 10/1983 | Adrian et al. | 241/19 |
| 4,470,901 | A | | 9/1984 | Burgess | |
| 5,243,922 | A | * | 9/1993 | Rehmat et al. | 110/233 |
| 2003/0183558 | A1 | * | 10/2003 | Sandlin et al. | 209/31 |
| 2006/0186234 | A1 | * | 8/2006 | Kerns et al. | 241/16 |
| 2007/0075002 | A1 | * | 4/2007 | Watters et al. | 209/711 |
| 2009/0064580 | A1 | * | 3/2009 | Nicoll et al. | 48/77 |
| 2009/0217590 | A1 | * | 9/2009 | Rappas et al. | 48/210 |

OTHER PUBLICATIONS

Written Opinion of the International Preliminary Examining Authority, issued for PCT/IB2009/052007, dated Nov. 2, 2010; 11 pages.

* cited by examiner

COAL PROCESSING OPERATION COMPRISING A DENSE MEDIA SEPARATION STAGE TO SEPARATE A COAL FEEDSTOCK INTO LOWER AND HIGHER ASH COAL STREAMS

The present application is a U.S. National Phase Application of International Application No. PCT/IB/2009/052007, filed May 14, 2009, which claims priority to South African Patent Application No. 2008/06498, filed Jul. 25, 2008 and entitled, "GASIFICATION OF COAL," the disclosures of which are hereby incorporated in their entirety by reference.

THIS INVENTION relates to a coal processing operation.

Conventionally, blending and washing systems are employed to improve the quality of a run-of-mine coal feedstock before further processing of the coal, by reducing the mineral content of the coal feedstock. Blending and washing produce two product streams, namely a first de-mineralized stream low in mineral (ash) content for further use, typically in a single downstream process employing, for example, a particular gasification technology, and a second discard stream high in mineral content.

The production of a discard stream is undesirable. The discard stream contains at least some coal (carbon) and the non use of this stream reduces the overall carbon efficiency of any process using the run-of-mine coal.

According to the invention, there is provided a coal processing operation which includes

- in a dense media separation stage, subjecting a coal feedstock which includes minerals to dense media separation producing a first coal stream and a second coal stream, coal in the first coal stream being lower in ash and having a lower ash fusion temperature than coal in the second coal stream;
- processing coal from the first coal stream in a high temperature coal processing operation; and
- processing coal from the second coal stream in a medium temperature coal processing operation.

A high temperature coal processing operation in this specification is typically a slagging coal processing operation, i.e. a coal processing operation which can tolerate slagging of the ash, whereas a medium temperature coal processing operation in this specification typically is a non-slagging coal processing operation, i.e. a coal processing operation which can not tolerate slagging of the ash.

The high temperature coal processing operation may be selected from the group consisting of a coal coking operation, a high temperature coal gasification operation and a coal combustion operation for generation of heat and/or steam. In all of these examples, slagging of the coal ash occurs or can at least in principle be tolerated.

The medium temperature coal processing operation may be a coal pyrolysis operation or a medium temperature coal gasification operation. In such a medium temperature coal gasification operation, slagging of the coal ash can not be tolerated and dry ash is produced.

According to one embodiment of the invention, coal from the first coal stream is processed in a coal coking operation and coal from the second coal stream is processed in a medium temperature coal gasification operation.

According to another embodiment of the invention, coal from the first coal stream is processed in a coal combustion operation to produce steam, with the steam being used for gasifying the second coal stream in a medium temperature coal gasification operation.

In a preferred embodiment of the invention, coal from the first coal stream is processed in a high temperature coal gasification operation and coal from the second coal stream is processed in a medium temperature coal gasification operation.

In this specification, a high temperature coal gasification operation is a coal gasification operation employing a high temperature gasifier in which maximum continuous operating temperatures exceed the melting point of minerals contained in the coal. Typically, this means maximum continuous operating temperatures exceeding 1300° C., more typically exceeding 1400° C. A medium temperature coal gasification operation is a coal gasification operation employing a medium temperature coal gasifier in which maximum continuous operating temperatures are below the melting point of minerals contained in the coal. Typically, this means maximum continuous operating temperatures between 1000° C. and 1400° C.

Advantageously, the coal processing operation of the invention allows two coal utilisation processes or operations to be operated in parallel from an initially common coal feedstock, eliminating the production of a coal discard stream.

The high temperature coal gasification operation may employ at least one high temperature entrained flow gasifier. The medium temperature coal gasification operation may employ at least one fixed bed dry bottom gasifier, or at least one medium temperature fluidised bed gasifier.

A high temperature entrained flow gasifier is typically a non-catalytic, high temperature, pressurised or non-pressurised (e.g. atmospheric) gasifier for the production of synthesis gas from a solid carbonaceous feedstock such as coal by partial oxidation of the feedstock in the presence of a gasification agent comprising at least oxygen and optionally steam, with the feedstock being finely ground or pulverized and entrained in the gasification agent, and with the gasifier being operated at a temperature above the melting point of minerals contained in the coal. Examples of non-pressurised high temperature entrained flow gasifiers are atmospheric entrained flow and atmospheric plasma gasifiers.

A fixed bed dry bottom gasifier is typically a non-catalytic, medium temperature, pressurised or non-pressurised (e.g. atmospheric) gasifier for the production of synthesis gas from a solid carbonaceous feedstock such as coal by partial oxidation of the feedstock in the presence of a gasification agent comprising at least oxygen and steam or air and steam, with the feedstock being in lump or granular form and being contacted with the gasification agent in a fixed bed and with the fixed bed being operated at a temperature below the melting point of minerals contained in the coal.

A medium temperature fluidised bed gasifier is typically a non-catalytic, medium temperature, pressurised or non-pressurised (e.g. atmospheric) gasifier for the production of synthesis gas from a solid carbonaceous feedstock such as coal by partial oxidation of the feedstock in the presence of a gasification agent comprising at least oxygen and steam or air and steam, with the feedstock being in lump or granular form and being contacted with the gasification agent in a fluidised bed and with the fluidised bed being operated at a temperature below the melting point of minerals contained in the coal.

A pyrolysis process is a process for the devolitilisation of a volatile-containing carbonaceous feedstock at elevated temperature, for example by flash pyrolysis, to yield a solid char product and liquid volatile-containing product.

A combustion process is a process for the rapid oxidation of a carbonaceous feedstock, for example in a coal fired boiler, to generate heat energy. The heat energy may be used for the generation of steam.

Coking is a process for driving off the volatile constituents of the coal, including water, coal gas and coal tar, by high temperature treatment of coal in an oxygen-free atmosphere and possibly above the melting point of the minerals contained in the coal, to fuse together the carbon and residual ash.

At the heart of the present invention is the use of dense media separation to differentiate coal on the basis of ash fusion temperature, for subsequent use of differentiated high and low ash fusion temperature coals in parallel coal processing operations employing different technologies. Any conventional dense media separation stage or technology may be employed, provided that it can separate coal using a relative density split in the range of 1.4 to 2.1.

The ash fusion temperature of a coal source gives an indication of the extent to which ash agglomeration, clinkering or slagging are likely to occur within a gasifier. Ash clinkering inside a fixed bed gasifier can cause channel burning, pressure drop problems and unstable gasifier operation, whereas in entrained flow gasification technologies, flux addition and slag viscosity are critical operational parameters affected by the ash fusion temperature of the coal being gasified.

In ash fusion temperature analysis the softening and flow (melting or slagging) behaviour of ash as it is heated through various temperature ranges to a specified temperature are measured. Normally this is up to 1600° C. under oxidising conditions, depending on equipment limitations. A cone of ash is prepared by a standard ashing procedure, e.g. as prescribed in ASTM Methods D1857 or ISO Method ISO540, and then heated at a controlled rate in an oxidising atmosphere to simulate the gasification environment in an ash bed. The results of an ash fusion temperature analysis consist of four temperatures, namely an initial deformation temperature where first rounding of a tip of the ash cone is taking place, a softening or sphere temperature where the cone height equals the cone width, a hemispherical temperature where the cone height equals half of the cone width, and the fluid or flow temperature where the cone height equals 1.6 mm.

Although ash fusion temperature tests are widely employed, they do not always predict the ash fusion temperature behaviour accurately. Two ashes which have apparently similar mineral compositions can have significantly different melting behaviours. Advantages of the standard ash fusion tests, e.g. ASTM D1857, are that they are widely employed, standardised, inexpensive and capable of automation. Concerns against the standard ash fusion temperature tests are that they are subjective because they are based on observations rather than measurements, that their reproducibility is poor, that the initial deformation temperature is not the temperature at which melting begins, and that the ash fusion temperatures are measured over short periods, whereas deposits, typically accumulated for hours, are formed during cooling.

Ash fusion temperatures can be measured under either oxidising or reducing conditions, or both, with the difference between the oxidising and reducing results often correlating strongly with fluxing agents such as iron.

Operating experience with a Sasol® FBDB™ gasifier has indicated that ideal gasifier operation is achieved when maximum temperatures obtained within the gasifier are maintained above the initial deformation temperature, to obtain enough agglomeration to improve bed permeability, and below the fluid or flow temperature, to prevent excessive clinkering. Ideal coal sources for fixed bed dry bottom gasification have a large temperature range between the initial deformation temperature and the fluid or flow temperature. Coal sources currently used for gasification in South Africa have a fluid or flow temperature greater than 1300° C. and an initial deformation temperature of greater than 1200° C. but below 1400° C.

An additional or coincidental advantage of the present invention is that the use of a lower ash fusion temperature coal in a high temperature gasifier such as a high temperature entrained flow gasifier may result in a lower slag viscosity during high temperature gasification. This is however not always the case as slag viscosity is also dependent on the coal mineral composition and not just on ash fusion temperature. In the case where the use of a lower ash fusion temperature coal in a high temperature gasifier does lead to reduced slag viscosity, less flux addition to the gasifier may advantageously be required to control slag tapping.

The first coal stream may have an ash fluid or flow temperature (determined under a reducing atmosphere) of less than 1400° C., preferably less than 1380° C., more preferably less than 1350° C., e.g. 1320° C.

The second coal stream may have an ash fluid or flow temperature (determined under a reducing atmosphere) of more than 1400° C., preferably more than 1450° C., more preferably more than 1500° C., e.g. 1550° C.

In one embodiment of the invention, the first coal stream has an ash fluid or flow temperature (determined under a reducing atmosphere) of less than 1380° C. and the second coal stream has an ash fluid or flow temperature (determined under a reducing atmosphere) of more than 1450° C.

In the dense media separation stage, a relative density split will thus be selected to ensure that the first coal stream and the second coal stream have the desired ash fusion temperature characteristics. A typical relative density split, for a South African coal, would be about 1.8 or 1.9. For most run-of-mine coals, or at least for most run-of-mine coals obtained from South African mines, the second coal stream will be significantly smaller than the first coal stream, e.g. about four times smaller than the first coal stream on a mass basis.

The invention will now be described, by way of example, with reference to the accompanying diagrammatic drawings and the Examples.

Figure 1:
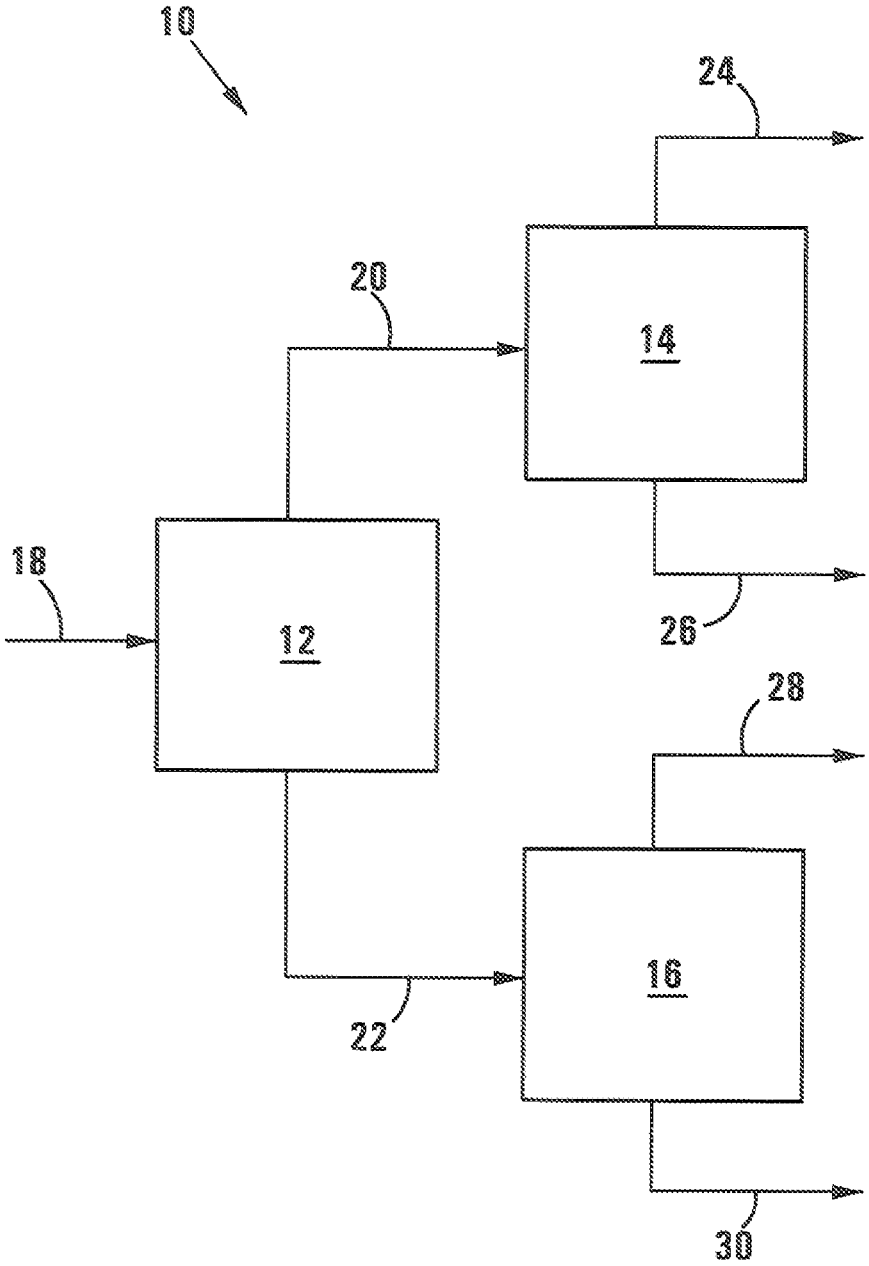
FIG. 1 shows a process in accordance with the invention for processing coal.

Referring to FIG. 1 of the drawings, reference numeral 10 generally indicates a process in accordance with the invention for processing coal. The process 10 includes, broadly, a dense media separation stage 12, a high temperature entrained flow gasifier 14 and a Sasol® FBDB™ gasifier 16.

A run-of-mine coal feed line 18 leads to the dense media separation stage 12. A first coal stream line 20 leads from the dense media separation stage 12 to the high temperature entrained flow gasifier 14, and a second coal stream line 22 leads from the dense media separation stage 12 to the fixed bed dry bottom gasifier 16.

A raw synthesis gas line 24 and a slag line 26 leave the high temperature entrained flow gasifier 14. Similarly, a raw synthesis gas line 28 and a dry ash line 30 leave the fixed bed dry bottom gasifier 16.

In use, run-of-mine coal is fed by means of the run-of-mine coal feed line 18 to the dense media separation stage 12. The dense media separation stage 12 is a conventional dense media separation stage comprising a dense-medium vessel into which the coal is fed. An upward separation medium current flow is maintained in the dense-medium vessel. Typically, coal from a raw coal screen and/or a pre-wet screen (not shown) merge with a major volume portion of circulating separation medium as push medium, guided by an adjustable submerged baffle plate. The coal is deep fed into the dense-medium vessel. A remaining volume portion of the circulating separation medium enters from a purge and drain for hoppers at the bottom of the dense-medium vessel. This generates a gentle upward separation medium current flow in the separator, which prevents dense media stratification and settling and merges as part of the push medium.

Based on float and sink analysis, e.g. using a method such as ISO7936, the dense media separation stage 12 is operated to produce a first coal stream or float fraction which is lower in density, lower in ash and has a lower ash fusion temperature, and a second coal stream or sink fraction which is higher in density, higher in ash and has a higher ash fusion temperature. For a typical South African coal, the dense media separation stage 12 may be operated to split the first coal stream and the second coal stream at a relative density of about 1.8 or 1.9.

Figure 2:
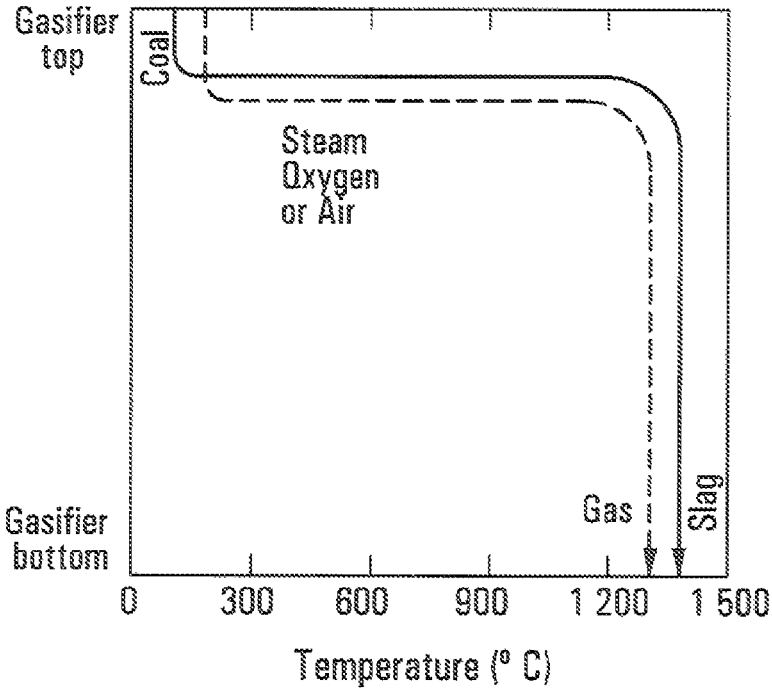
FIG. 2 shows a typical temperature profile of a high temperature entrained flow gasifier.
Figure 3:
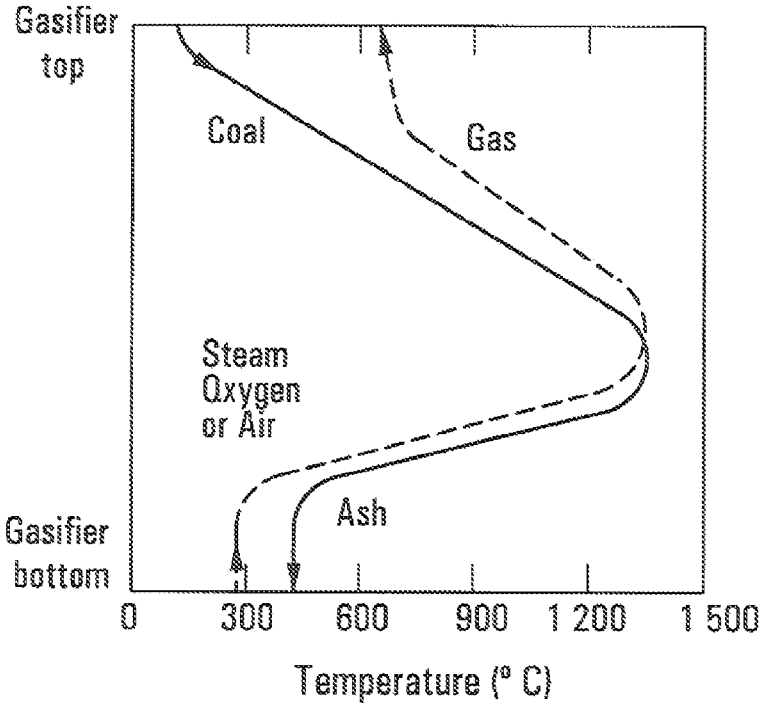
FIG. 3 shows a typical temperature profile of a fixed bed dry bottom gasifier.

The first coal stream is removed by means of the first coal stream line 20 and fed to the high temperature entrained flow gasifier 14 where the coal is gasified in conventional manner, using a typical gasifier temperature profile as shown in FIG. 2, producing a raw synthesis gas withdrawn by means of the raw synthesis gas line 24, and a molten slag withdrawn by means of the slag line 26. Similarly, the second coal stream is fed by means of the second coal stream line 22 to the fixed bed dry bottom gasifier, e.g. a Sasol® FBDB™ gasifier, where the coal is gasified in conventional manner using a typical gasifier temperature profile as shown in FIG. 3, producing a raw synthesis gas which is withdrawn by means of the raw synthesis gas line 28, and dry ash which is withdrawn by means of the ash line 30.

Typically, the process 10 will employ a plurality of high temperature entrained flow gasifiers operating in parallel, all receiving coal from the first coal stream and a plurality of fixed bed dry bottom gasifiers operating in parallel, all receiving coal from the second coal stream.

EXAMPLE 1

The process 10 can be employed to gasify a typical South African Highveld coal source. Float and sink analysis of the coal and ash analysis and ash fusion temperature (flow temperature or FT) analysis of different float fractions of a 500 kg sample of the coal over a relative density range of from 1.4 to 2.1 provided the following results:

| Description | F1.40 | F1.50 | F1.60 | F1.70 | F1.80 | F1.90 | F1.95 | F2.0 | F2.1 | S2.1 |
|---|---|---|---|---|---|---|---|---|---|---|
| Yield | 12.58 | 29.34 | 63.42 | 77.62 | 84.40 | 85.61 | 86.81 | 88.78 | 90.25 | 100.00 |
| Ash content (mass %) | 9.5 | 12.4 | 17.4 | 19.6 | 21.2 | 21.5 | 21.9 | 22.6 | 23.1 | 28.4 |
| ASH FUSION TEMPERATURES - REDUCING | | | | | | | | | | |
| FT ° C. | 1400 | 1370 | 1380 | 1370 | 1380 | 1450 | 1400 | 1500 | 1540 | 1400 |

The yield given is cumulative. Washing of the coal was simulated by means of float/sink analysis according to ISO 7936 standard, where a −25 mm+0.5 mm size fraction sample was prepared by crushing and screening steps. Individual particle size fractions >25 mm were crushed to −25 mm and screened at 0.5 mm before washing.

Figure 4:
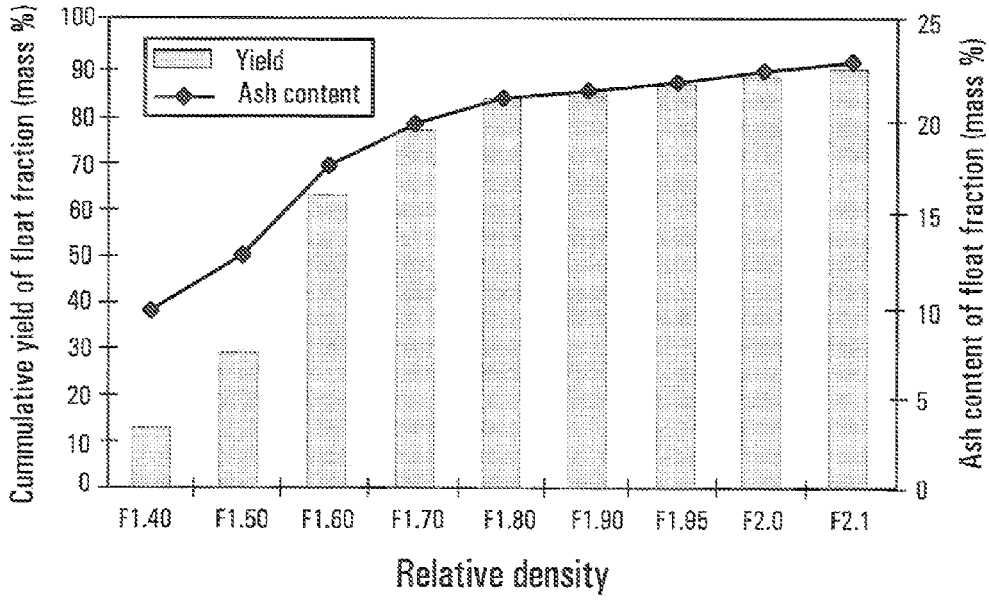
FIG. 4 shows graphs of cumulative yield and ash content as a function of relative density for a typical South African coal.

The wash curve of the coal sample as well as the ash content of the coal (for the cumulative float fractions), are given in FIG. 4.

The ash content of the run-of-mine coal stream is 28.4% and the ash fusion temperature (flow temperature)>1450° C. To split the coal in order to have more than one gasification technology running on the coal stream at optimum conditions, the coal can be split using the dense media separation stage 12 at a relative density of 1.8 or 1.9. This will produce two streams with distinct properties as indicated below.

| Description | F1.40 | F1.50 | F1.60 | F1.70 | F1.80 | F1.90 | F1.95 | F2.0 | F2.1 | S2.1 |
|---|---|---|---|---|---|---|---|---|---|---|
| Yield | 12.58 | 29.34 | 63.42 | 77.62 | 84.40 | 85.61 | 86.81 | 88.78 | 90.25 | 100.00 |
| Ash content (mass %) | 9.5 | 12.4 | 17.4 | 19.6 | 21.2 | 21.5 | 21.9 | 22.6 | 23.1 | 28.4 |
| ASH FUSION TEMPERATURES - REDUCING | | | | | | | | | | |
| FT ° C. | 1400 | 1370 | 1380 | 1370 | 1380 | 1450 | 1400 | 1500 | 1540 | 1400 |
| | High temperature gasification | | | | | | Medium temperature gasification | | | |
| | | | | | Split point | | | | | |

A first coal stream or float fraction for high temperature gasification will have an ash content of 21.2% and an ash fusion temperature (flow temperature) less than about 1380° C., whereas a second coal stream or sink fraction for medium temperature gasification will have an ash content >30% and an ash fusion temperature (flow temperature) greater than about 1450° C. or in some cases greater than 1350° C., depending on the properties of the coal. The mass ratio of the first coal stream to the second coal stream will be about 85:15

EXAMPLE 2

The same coal as was used in Example 1 was also the subject of investigation in Example 2. Dense media separation and ash and composition analysis provided the information as set out in more detail in Table 1 below.

TABLE 1

| Description | | F1.40 | F1.50 | F1.60 | F1.70 | F1.80 | F1.90 | F1.95 | F2.0 | F2.1 | S2.1 |
|---|---|---|---|---|---|---|---|---|---|---|---|
| Yields | | 12.58 | 16.76 | 34.08 | 14.20 | 6.78 | 1.21 | 1.20 | 1.97 | 1.47 | 9.76 |
| Inh. $H_20$ | % | 4.6 | 4.5 | 4.3 | 3.9 | 3.5 | 3.0 | 2.9 | 2.90 | 3.2 | 2.2 |
| Ash | % | 9.5 | 14.6 | 21.7 | 29.2 | 39.4 | 46.8 | 52.1 | 52.20 | 54 | 77 |
| Vol. Mat | % | 28.6 | 23.9 | 22.0 | 20.3 | 17.8 | 16.4 | 15.8 | 15.80 | 15.7 | 13 |
| Fix. Carbon | % | 57.3 | 57.0 | 52.0 | 46.6 | 39.3 | 33.8 | 29.2 | 29.10 | 27.1 | 7.8 |
| $SiO_2$ | % | 36.80 | 39.00 | 45.70 | 50.40 | 54.40 | 57.10 | 57.70 | 58.40 | 63.3 | 59 |
| $Al_2O_3$ | % | 25.80 | 25.50 | 26.00 | 26.50 | 26.00 | 25.20 | 23.80 | 25.70 | 24.5 | 22.2 |
| $Fe_2O_3$ | % | 2.31 | 1.24 | 2.67 | 3.06 | 3.92 | 5.12 | 5.69 | 4.59 | 2.07 | 5.48 |
| P2O5 | % | 2.43 | 2.01 | 1.11 | 0.78 | 0.51 | 0.39 | 0.41 | 0.36 | 0.44 | 0.15 |
| $TiO_2$ | % | 1.88 | 1.36 | 1.37 | 1.46 | 1.54 | 1.48 | 1.59 | 1.66 | 1.9 | 1.29 |
| CaO | % | 14.40 | 15.20 | 11.90 | 8.77 | 6.75 | 4.13 | 4.73 | 3.92 | 3.17 | 5.11 |
| MgO | % | 3.51 | 4.44 | 4.09 | 3.24 | 2.20 | 1.34 | 1.29 | 1.14 | 1.04 | 0.62 |
| $K_2O$ | % | 0.59 | 0.57 | 0.66 | 0.83 | 0.81 | 0.84 | 0.84 | 0.84 | 0.96 | 1.14 |
| $Na_2O$ | % | 1.02 | 0.78 | 0.57 | 0.42 | 0.37 | 0.27 | 0.25 | 0.29 | 0.26 | 0.15 |
| $SO_3$ | % | 9.63 | 8.74 | 5.16 | 3.54 | 3.36 | 2.94 | 2.76 | 1.98 | 1.15 | 3.59 |

In Table 1, the analysis for each relative density float fraction is provided with the actual yield of each float fraction, unlike Example 1 where cumulative yield is given.

From Table 1 it is clear that significant differences in ash content, as well as ash composition, were obtained by dense medium separation.

Cumulative yields (float fractions) above a relative density (RD)=1.8 were relatively high (>80%), whereafter the yield decreased significantly towards washing at lower relative densities, as shown in FIG. 4.

The ash content (on a cumulative basis) decreased from 21.9% at a RD=1.95 to as low as 9.5% at a RD=1.4. Taking this into account, it is expected that the mineral composition of the different fractions will differ significantly, which is born out by the data in Table 1, which also clearly indicates the high ash content of the individual float fractions between RD=1.8 and RD=2.1.

Another interesting result is the effect of dense medium separation on the ash fusion temperature (flow temperature) and mineral composition of the product. The changes in ash fusion temperature (flow temperature) for cumulative float fractions and the changes in mineral composition in as far as Ca-content is concerned for individual float fractions, are shown in FIG. 5.

Figure 5:
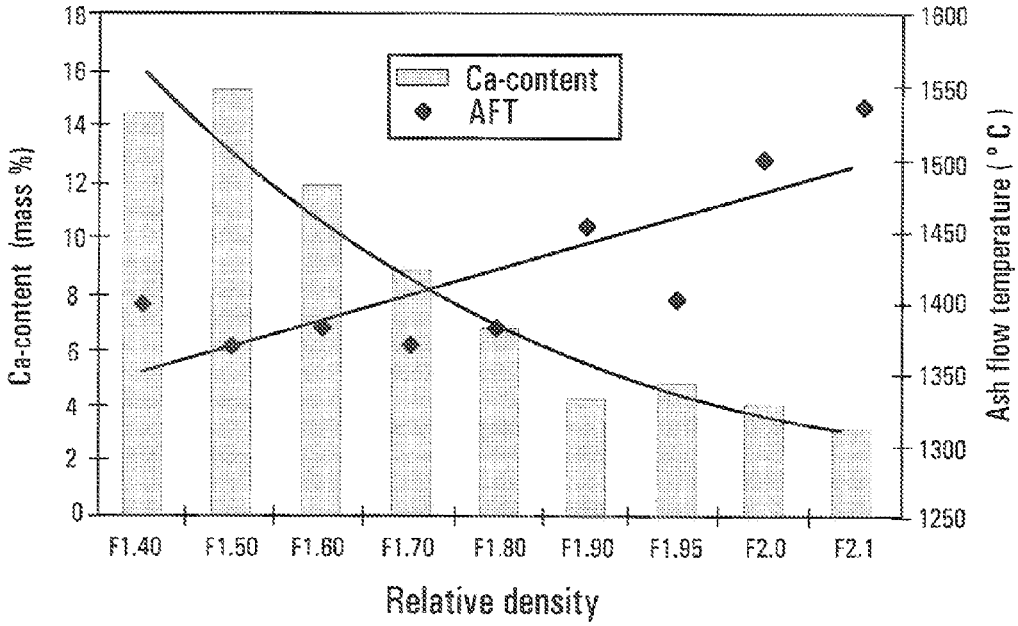
FIG. 5 shows graphs of calcium content and ash flow temperature as a function of relative density of the typical South African coal of FIG. 4.

From FIG. 5 a few observations can be made:

The ash flow temperature (AFT) increased with INCREASING relative density. The highest ash flow temperature is observed at the HIGHEST relative density (RD=2.1), which also has the lowest Ca-content (FIG. 5).

The Ca-content changed significantly with dense medium separation. The highest Ca-content is observed at lower relative densities (i.e. RD=1.5 in this case).

The characteristics (proximate and ash composition) of the fractions were used individually to quantify slag-liquid formation during gasification using FactSage (trade name) modelling. The individual fractions were treated as individual coal sources as if gasified individually per prepared fraction.

Figure 6:
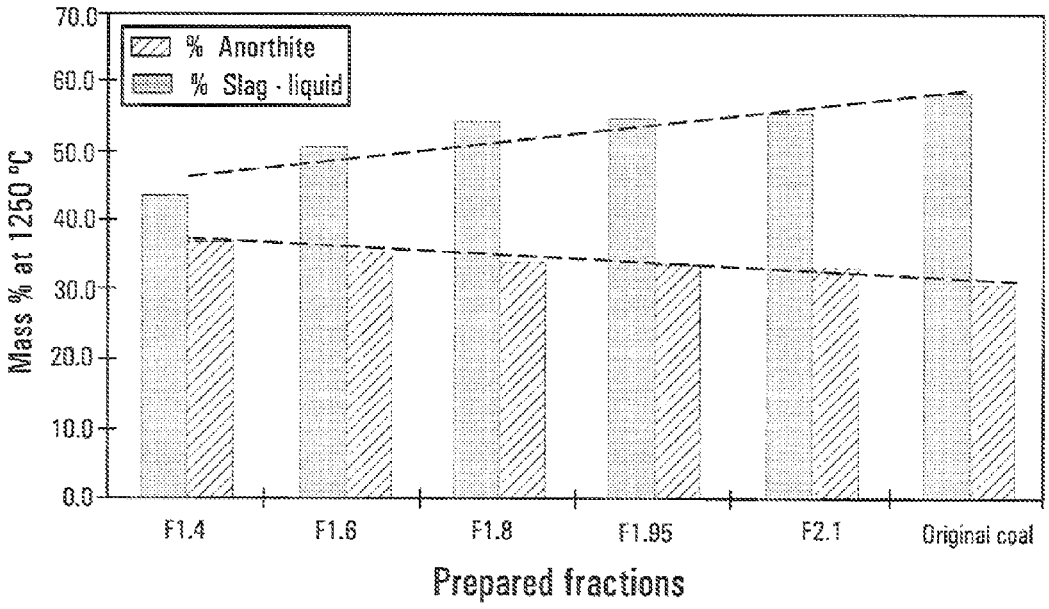
FIG. 6 shows graphs of the mass fraction of anorthite ($CaAl_2Si_2O_8$) and slag-liquid at 1250° C. as a function of the relative density of the typical South African coal of FIG. 4.

With reference to FIG. 6, results indicated that the amount of anorthite ($CaAl_2Si_2O_8$) in coal ash increased with decreasing relative density of the coal and that the amount of slag-liquid present at 1250° C. during gasification decreased with decreasing relative density of the coal. The higher concentration of CaO in lower density coal seems to result in a higher amount of anorthite formation. The anorthite is formed as a product between the $SiO_2$, $Al_2O_3$ and Ca-containing species. Thus, a minimum amount of fluxing agent, which enhances slag-liquid formation and anorthite crystallization and a high concentration of acid component $SiO_2$, which suppresses slag-liquid formation, are then present, to form a slag-liquid material. The coal fractions with the highest concentration of CaO and acidic components ($Al_2O_3$ and $SiO_2$) resulted in the highest percentage of Ca—Al—Si minerals ($CaAl_2Si_2O_8$—anorthite plus $CaAl_4Si_2O_{10}(OH)_2$ margarite) formation. The free-$SiO_2$ in the mineral structure of coal sources resulted then in forming minerals containing Mg, Na or Ca to form new mineral compounds such as $KAl_3Si_3O_{10}(OH)_2$ (muscovite), $Mg_5Al_2Si_3O_{10}(OH)_8$ (clinochlore), or other high oxygen molecule-capture mineral compounds. Thus, if the free-$SiO_2$ is decreased or not present after gasification, i.e. by an increase in anorthite formation as with the float fraction at RD=1.4, the concentration of Si-oxygen capture compounds was then relatively low, with a high concentration of anorthite forming, as in the prepared fraction at RD=1.4 in this Example.

It was also observed that for CaO contents <10%, the predicted slag-liquid temperature from FACT-Win/F*A*C*T (trade name) modelling is comparable with the standard flow temperature according to an as fusion temperature analysis, with a difference less than 10° C. The increasing difference with increasing CaO content should however be further explained. It is known that differences between predicted liquid temperatures from FACT-Win/F*A*C*T modelling and ash fusion temperature measurements were also observed for high Ca and Fe containing coal sources. The higher CaO-containing coal sources (such as the fractions prepared at lower relative densities in this Example), contain higher concentrations of anorthite ($CaAl_2Si_2O_8$) than the slag liquid, as also observed and confirmed in this study. In high CaO content coal sources, the Al—Si—Ca particles cause delay in the formation of slag-liquid.

The process of the invention, as illustrated, advantageously allows a common coal source which includes a significant concentration of minerals to be processed in two or more different operations of which at least one can tolerate slag formation and at least one can not tolerate slag formation. In a preferred embodiment of the invention, the coal processing operation, as illustrated, enables the entire coal feedstock stream to be gasified using different gasification technologies in parallel, eliminating or at least significantly reducing the production of a high mineral content coal discard stream.

The invention claimed is:

1. A coal processing operation which includes:

in a dense media separation stage, subjecting a coal feedstock, which includes minerals, to dense media separation using a relative density split in the range of 1.4 to 2.1 producing a first coal stream and a second coal stream, coal in the first coal stream being lower in density, lower in ash and having a lower ash fusion temperature than coal in the second coal stream, the second coal stream including at least some of the minerals from the coal feedstock;

processing coal from the first coal stream in a coal processing operation selected from the group consisting of a coal coking operation, a coal gasification operation in which a maximum operating temperature exceeds the melting point of minerals contained in the coal so that slagging occurs, and a coal combustion operation for generation of a selection from the group consisting of heat, steam and combinations thereof; and processing coal from the second coal stream in a coal processing operation which is a coal pyrolysis operation or a coal gasification operation in which a maximum operating temperature is below the melting point of minerals contained in the coal so that slagging of the minerals does not occur.

2. The operation as claimed in claim 1, in which coal from the first coal stream is processed in a coal coking operation and coal from the second coal stream is processed in a coal gasification operation in which a maximum operating temperature is below the melting point of minerals contained in the coal so that slagging of the minerals does not occur.

3. The operation as claimed in claim 1, in which coal from the first coal stream is processed in a coal combustion operation to produce steam, with the steam being used for gasifying the second coal stream in a coal gasification operation in which a maximum operating temperature is below the melting point of minerals contained in the coal so that slagging of the minerals does not occur.

4. The operation as claimed in claim 1, in which coal from the first coal stream is processed in a coal gasification operation in which a maximum operating temperature exceeds the melting point of minerals contained in the coal so that slagging occurs and coal from the second coal stream is processed in a coal gasification operation in which a maximum operating temperature is below the melting point of minerals contained in the coal so that slagging of the minerals does not occur.

5. The operation as claimed in claim 4, in which the coal gasification operation in which a maximum operating temperature exceeds the melting point of minerals contained in the coal so that slagging occurs employs at least one entrained flow gasifier and in which the coal gasification operation in which a maximum operating temperature is below the melting point of minerals contained in the coal so that slagging of the minerals does not occur employs at least one fixed bed dry bottom gasifier, or at least one fluidised bed gasifier.

6. The operation as claimed in claim 1, in which said relative density split in the dense media separation stage is selected such that the first coal stream has an ash fluid or flow temperature (determined under a reducing atmosphere) of less than 1400° C.

7. The operation as claimed in claim 1, in which said relative density split in the dense media separation stage is selected such that the second coal stream has an ash fluid or flow temperature (determined under a reducing atmosphere) of more than 1400° C.

8. The operation as claimed in claim 1, in which said relative density split in the dense media separation stage is selected such that the first coal stream has an ash fluid or flow temperature (determined under a reducing atmosphere) of less than 1380° C. and the second coal stream has an ash fluid or flow temperature (determined under a reducing atmosphere) of more than 1450° C.

* * * * *